US005248579A

United States Patent [19]

Terrell et al.

[11] Patent Number: 5,248,579

[45] Date of Patent: Sep. 28, 1993

[54] ELECTROPHOTOGRAPHIC RECORDING MATERIAL

[75] Inventors: David R. Terrell, Lint; Stefaan K. De Meutter, Zandhoven, both of Belgium

[73] Assignee: Agfa-Gevaert, N.V., Mortsel, Belgium

[21] Appl. No.: 851,263

[22] Filed: Mar. 13, 1992

Related U.S. Application Data

[63] Continuation of Ser. No. 537,634, Jun. 14, 1990, abandoned.

[30] Foreign Application Priority Data

Jun. 16, 1989 [EP] European Pat. Off. ..... 89201573.6

[51] Int. Cl.[5] ..... G03G 5/09

[52] U.S. Cl. ..... 430/58; 430/81; 430/96

[58] Field of Search ..... 430/58, 59, 81, 88, 430/96

[56] References Cited

U.S. PATENT DOCUMENTS 4,302,521 11/1981 Takei et al. ..... 430/58

4,800,145 1/1989 Nelson et al. ..... 430/58

*Primary Examiner*—Marion E. McCamish

*Assistant Examiner*—S. Rosasco

*Attorney, Agent, or Firm*—Breiner & Breiner

[57] ABSTRACT

An electrophotographic recording material comprising on an electrically conductive support a positively chargeable photoconductive recording layer which contains in an electrically insulating organic polymeric binder material at least one photoconductive p-type pigment substance, and at least one n-type photoconductive charge transport substance selected from one of the following classes:

(i) aromatic monoketones;

(ii) aromatic polyketones;

(iii) aromatic polyketones of (ii) condensed with at least one molecule of malonoitrile, a malononitrile monocarboxy ester or a malonic acid diester;

(iv) cyano alkylene compounds;

(v) aromatic compounds with at least one electron withdrawing substituent, wherein said layer has a thickness in the range of 4 to 40 μm and comprises 5 to 40% by weight of said p-type pigment substance and 0.0001 to 15% by weight of said n-type charge transport substance that is molecularly distributed in said electrically insulating organic polymeric binder material that has a volume resistivity of at least $10^{14}$ Ohm-m, and wherein said recording layer in electrostatically charged state requires for 10% and 90% discharge respectively exposures to conductivity increasing electromagnetic radiation that differ by a factor 5 or less.

11 Claims, 4 Drawing Sheets

ELECTROPHOTOGRAPHIC RECORDING MATERIAL

This is a continuation of copending application Ser. No. 07/537,634 filed on Jun. 14, 1990, now abandoned.

The present invention relates to a photosensitive recording material suitable for use in electrophotography.

In electrophotography photoconductive materials are used to form a latent electrostatic charge image that is developable with finely divided colouring material, called toner.

The developed image can then be permanently affixed to the photoconductive recording material, e.g. photoconductive zinc oxide-binder layer, or transferred from the photoconductor layer, e.g. selenium layer, onto a receptor material, e.g. plain paper and fixed thereon. In electrophotographic copying and printing systems with toner transfer to a receptor material the photoconductive recording material is reusable. In order to permit a rapid multiple printing or copying a photoconductor layer has to be used that rapidly looses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

Another important property which determines whether a particular photosensitive recording material is suitable for electrophotographic systems is its discharge-exposure relationship. Conventional recording materials on the basis of an electrostatically charged photoconductive layer exhibit a fairly gradual increase in discharge as a function of increasing exposure to photoconductivity increasing electromagnetic radiation. The radiation dose, also called exposure, required for 10% and 90% discharge differs normally by factors of about 10 to 40 depending on the choice of photoconductive recording material.

Electrophotographic copying systems wherein such photoconductive recording materials are used in the reproduction of halftone image originals, i.e. images composed of equi-dense screen dots in which density variation is obtained only by varying dot frequency or by varying dot size and dot frequency, yield images of degraded quality (resolution) when compared with images obtained on lith-type silver halide emulsion materials.

Electrophotographic printing systems operating with scanning light sources such as analog-signal or digital-signal modulated laser beams or light emitting diodes with such photoconductive recording materials likewise produce degraded prints due to the enhancement of background and the blurring of the dots as a result of each dot having a halo caused by the unsharp edge of the writing beam.

It is therefore desirable for high quality electrophotographic copying and printing to have a photoconductive recording material with a sharp decrease in charge expressed in voltage (V) (as a result of sharp increase in conductivity) within a narrow range of photo-exposure dose (E) [E=photon-intensity (I)×time (t)]. More explicitly it is desirable in order to avoid said image quality degradation to work with a photoconductive recording material with which the exposures required for 10% and 90% discharge differ by a factor of only 5 or less.

Another important property which determines whether or not a particular photoconductive material is suited for electrophotographic copying is its photosensitivity that must be high enough for use in copying apparatus operating with fairly low intensity light reflected from the original.

Commercial usefulness further requires that the photoconductive layer has a chromatic sensitivity that matches the wavelength(s) of the light of the light source, e.g. a laser or has panchromatic sensitivity when white light is used e.g. to allow the reproduction of all colours in balance.

Intensive efforts have been made to satisfy said requirements, e.g. the spectral sensitivity of selenium has been extended to the longer wavelengths of the visible spectrum by making alloys of selenium, tellurium and arsenic. In fact selenium-based photoconductors remained for a long time the only really useful photoconductors although many organic photoconductors were discovered.

The first generation of organic photoconductors consisted of single layers in which a polymeric charge transport material such as poly(N-vinylcarbazole) (PVK) or charge transport molecules such as the 1,2-dihydro-2,2,4-trimethylquinoline derivatives described in U.S. Pat. Nos. 3,830,647 and 3,832,171 dissolved in an inert polymeric binder such as a polycarbonate were sensitized with dissolved dyes or dispersed pigment particles. Examples of the latter are the so-called "photoemission active material" (PEAM) layers such as those disclosed by Regensburger and Jakubowski in U.S. Pat. No. 3,877,935 for novel xerographic plates containing photoinjecting polynuclear quinone pigments including 4,10-dibromoanthanthrone in concentrations of 0.1 to 5 percent by volume with 5 to 99 percent by volume of photoconductor material. Hackett also described such layers in 1971 in the Journal of Chemical Physics, Volume 55, page 3178 consisting of 25 wt % X-phthalocyanine dispersed in poly(N-vinylcarbazsole).

D. R. Keams, G. Tollin and M. Calvin have reported in the Journal of Chemical Phycis (Vol. 29, page 950 [1958] and Vol. 32, page 1020 [1960]) that at room temperature the dark conductivity of pressed discs of phthalocyanine-o-chloranil mixtures increase with increasing o-chloranil concentration from $10^{-9}$ $\Omega^{-1}$-$cm^{-1}$ for pure phthalocyanine to $10^{-2}$ $\Omega^{-1}$-$cm^{-1}$. This makes the attainment of an acceptable contrast potential of about 500 V impossible using corona charging. Moreover, K. Nakatani, J. Hanna and H. Kokado in their 1985 paper in the Japanese journal "Electrophotography", volume 24, page 2 showed that the dark conductivities of two layer organic photoconductors consisting of a 15 μm transport layer consisting of 50% p-diethylaminobenzaldehyde-diphenylhydrazone in polyester and a charge generating layer consisting of metal-free phthalocyanine and an electron acceptor at a concentration of about 10% by weight increased with the electron affinity (EA) of the electron acceptor with a 500-fold jump between EA's of 1.37 and 1.55 eV (the EA of o-chloranil). On the basis of these observations a photoconductor based on a mixture of metal-free phthalocyanine and o-chloranil would seem unlikely to be able to attain an acceptable contrast potential using corona charging.

Furthermore Regensburger disclosed in published German patent application (DE-OS) 2 108 963 photoreceptor-binder layers consisting of photoconductive particles dispersed in an electronically active organic binder matrix, whereby the photoconductive particles contain photosensitive material which liberate electrons which can be injected into the surrounding active matrix material and which can be transported by the electronically active material. Said photoconductive particles can consist of an inorganic crystalline material or a phthalocyanine pigment, e.g. the $\chi$-or $\beta$-form of metal-free phthalocyanine or a metal-phthalocyanine. Said active binder matrix contains an organic electron-acceptor substance, e.g. chloranil. Said photoconductive particles are present in a volume ratio of 0.1 to 5% with respect to the binder matrix. No mention is made in said DE-OS of the sensitometric characteristics of the resulting photoconductive recording materials.

With 5 to 10 $\mu$m thick PEAM-layers consisting of about 40% by weight of the p-type charge transport material 2,4-bis(4-N,N-dimethylaminophenyl)oxadiazole, 0.5 to 10% by weight of N,N'-dimethylperylimide in a binder [ref. Chemiker Zeitung 106, 313 (1982)] Wiedemann observed photosensitivities expressed as half-value voltage drop exposures ($I_o \cdot t_{\frac{1}{2}}$) of 50 to 100 mJ/m2 for positive and negative charging.

Nakazawa, Muto and Tsutsumi in 1988 [Japan Hardcopy Proceedings May 16–18, 1988] described a positively chargeable 18 $\mu$m PEAM-layer with metal-free phthalocyanine and N,N'-bis(3,5-xylyl)perylimide as the sensitizing pigments and a charge carrier transport material, which exhibited optimal photosensitivity ($I_o \cdot t_{\frac{1}{2}}$) of 238 mJ/m2 at a metal-free phthalocyanine concentration of 0.3% by weight, a N,N'-bis(3,5-xylyl)-perylimide concentration of 5.4% by weight and a charge carrier transport material concentration of 40.4% by weight.

Such monlayer organic photoconductors were less interesting than selenium-photoconductors, because of their poorer sensitivity, their very flat response to increasing exposure dose and their rather large fatigue.

However, the discovery that 2,4,7-trinitro-9-fluorenone (TNF) in poly(N-vinylcarbazole) (PVCz) formed a charge-transfer complex strongly improving the photosensitivity (ref. U.S. Pat. No. 3,484,237) opened the way for the use of organic photoconductors in copying machines that could compete with the selenium-based machines.

TNF acts as an electron acceptor whereas PVCz serves as an electron donor. Films consisting of said charge transfer complex with TNF:PVCz in 1:1 molar ratio are dark brown, nearly black and exhibit high charge acceptance and low dark decay rates. However, the exposures required for 10% and 90% discharges differed by more than a factor of 10. Overall photosensitivity is comparable to that of amorphous selenium (ref. Schaffert, R. M., IBM J. Res. Develop., 15, 75 (1971).

Subsequently single layer photoconductive materials containing aggregates of photoconductors which are both positively and negatively chargeable were developed, e.g. consisting of ternary systems comprising a thio-pyrilium dye, a polycarbonate polymer and an aromatic molecule such as bis(4-N,N-diethylamino-2-methyl-phenyl)-phenylmethane. In 1979 Mey et al [J.Appl.Phys. 50, 8090 (1979)] published surface potential-exposure characteristics for such photoconductive recording materials with both negative and positive charging and for both emission-limited discharge and high-intensity flash. In all cases the exposures required for 10% and 90% discharges differed by more than a factor of 10.

A further search led to the discovery that if the sensitizing pigment in PEAM-layers were cast in a thin layer adjacent to a thicker layer solely consisting of transport molecules dissolved in an inert polymer binder or a polymeric charge transport material sensitivity comparable with selenium-photoconductors together with a much steeper response to increase in exposure does and a much reduced fatigue were observed. Hackett showed this in 1971 [J.Chem.Phys. 55, 3178 (1971)] for the system X-phthalocyanine and PVK. Hackett found that photoconductivity was due to field dependent photogeneration of electron-hole pairs in the phthalocyanine and hole injection into the PVCz. The transport of the positive charges, i.e. positive hole-conduction proceeded easily in the PVCz layer. From that time on much research has been devoted to developing improved photoconductive systems wherein charge generation and charge transport materials are separate in two contiguous layers (see e.g. U.K. Pat. No. 1,577,859). However, such functionally separated double layer photoconductors although generally exhibiting a steeper response to increasing exposure doses than single layer photoconductors still exhibit exposure doses for 10 and 90% discharge differing by a factor of 10 or more as shown in comparative examples furtheron.

It is an object of the present invention to provide electrophotographic recording materials with high photosensitivity which after being charged obtain a very sharp decrease in voltage [$\Delta V$] within a particular narrow range [$\Delta E$] of photo-exposure doses, viz. wherein the photo-exposure doses required for 10% and 90% discharge differ by a factor of 5 or less.

Other objects and advantages of the present invention will appear from the further description and examples.

In accordance with the present invention an electrophotographic recording material is provided comprising on an electrically conductive support a positively chargeable photoconductive recording layer which contains in an electrically insulating organic polymeric binder material at least one photoconductive p-type pigment substance, and at least one n-type photoconductive charge transport substance selected from one of the following classes:

(i) aromatic monoketones;
(ii) aromatic polyketones;
(iii) aromatic polyketones of (ii) condensed with at least one molecule of malononitrile, a malononitrile monocarboxy ester or a malonic acid diester;
(iv) cyano alkylene compounds;
(v) aromatic polycyclic compounds with at least one electron withdrawing substituent, wherein said layer has a thickness in the range of 4 to 40 $\mu$m and comprises 5 to 40% by weight of said p-type pigment substance and 0.0001 to 15% by weight of said n-type charge transport substance that is molecularly distributed in said electrically insulating organic polymeric binder material that has a volume resistivity of at least $10^{14}$ Ohm-m, and wherein said recording layer in electrostatically charged state requires for 10% and 90% discharge respectively exposures to conductivity increasing electromagnetic radiation that differ by a factor 5 or less.

The p-type pigment(s) may be inorganic or organic and may have any colour including white. It is a finely divided substance, e.g. with average particle size in the range from 0.01 to 1 micron, dispersible in the organic polymeric binder of said photoconductive recording layer.

Optionally the support of said photoconductive recording layer is pre-coated with an adhesive and/or a blocking layer (rectifier layer) reducing or preventing positive hole charge injection from the conductive support into the photoconductive recording layer, and optionally the photoconductive recording layer is overcoated with an outermost protective layer, more details about said layers being given futheron.

In accordance with a preferred embodiment said photoconductive recording layer has a thickness in the range of 5 to 35 μm and contains 6 to 30% by weight of said p-type pigment material(s) and 0.001 to 12% by weight of said n-type charge transport material(s).

By the term "n-type" substance is understood a substance having n-type conductance, which means that the photocurrent ($I_n$) generated in said substance when in contact with an illuminated transparent electrode having negative electric polarity is larger than the photocurrent ($I_p$) generated when the substance is in contact with a positive illuminated electrode ($I_n/I_p > 1$).

By the term "p-type" substance is understood a substance having p-type conductance, which means that the photocurrent ($I_p$) generated in said substance when in contact with an illuminated transparent electrode having positive polarity is larger than the photocurrent ($I_n$) generated when in contact with a negative illuminated electrode ($I_p/I_n > 1$), [ref. Hans Meier—Organic Semiconductors, Dark- and Photoconductivity of Organic Solids—Verlag Chemie (1974), p. 410, point 3.]

The electrically insulating binder has preferably a volume resistivity which is not higher than $10^{16}$ Ohm-m.

Examples of p-type pigments dispersible in the binder of the negatively chargeable recording layer of the electrophotographic recording material according to the present invention are:

a) naphthalo- and phthalo-cyanines such as metal-free, metal, metal-oxy, metal-halo and siloxy-silicon metal naphthalo- and phthalocyanines e.g. χ-metal-free phthalocyanines as described e.g. in U.S. Pat. Nos. 3,594,163; 3,816,118; 3,894,868 and CA-P 899,870; siloxy-silicon naphthalocyanines as described e.g. in EP-A 243 205; vanadyl phthalocyanines as described e.g. in U.S. Pat. No. 4,771,133; bromoindium phthalocyanines as described e.g. in U.S. Pat. Nos. 4,666,802 and 4,727,139; τ and η metal-free phthalocyanines as described e.g. in U.S. Pat. No. 4,749,637 and metal, metal-oxy and metal-halo naphthalocyanines as described e.g. in EP 288 876.

b) quinoxaline pigments e.g.

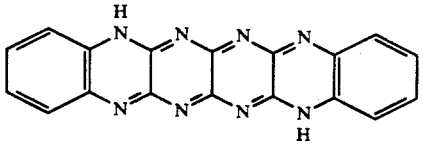

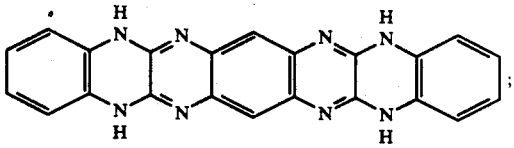

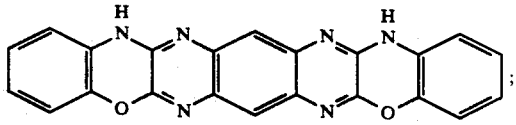

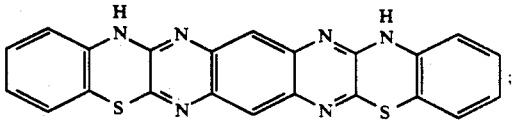

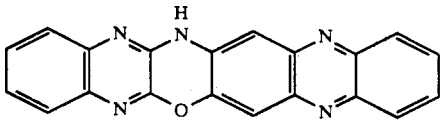

c) dioxazine pigments with the general formula:

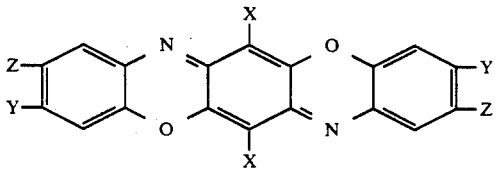

wherein

X is Cl, $CONHC_6H_5$, $NHOCCH_3$, $NHC_6H_5$, $CONH_2$;

Y is p-chlorophenyl, $NHC_6H_5$, $NHOCCH_3$, $NH_2$, $OC_6H_5$, H;

Z is H, alkoxy, e.g. $OC_2H_5$ or O-iso.$C_3H_7$, Cl, $NO_2$ or $COC_6H_5$;

or Z and Y together form a substituted or unsubstituted heterocyclic ring, e.g.;

Carbazole Dioxazine Violet (CI Pigment Violet 23, CI 51319) with the formula:

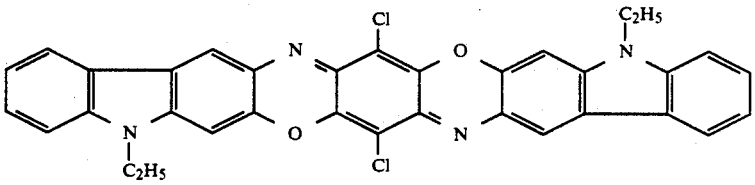

Examples of monomeric n-type charge transport substances that are particularly useful in the present invention and can be molecularly dissolved in an electrically insulating organic binder, e.g. a polycarbonate resin, are low molecular weight substances from one of the following classes:

(1) aromatic monoketones optionally substituted with at least one electron withdrawing substituent, e.g. halogen, nitro group, cyanide group, carboxylic acid ester group and/or acyl group, e.g. 2,4,7-trinitrofluorenone and 2,4,5,7-tetranitrofluorenone as described e.g. by R. O. Loutfy, C. K. Hsiao B. S. Ong and B. Keoshkerian in Canadian Journal of Chemistry, Vol. 62, page 1877 (1984);

(2) aromatic polyketones optionally substituted with at least one electron withdrawing substituent, e.g. halogen, nitro group, cyanide group, carboxylic acid ester group and/or acyl group, e.g. 2,3,5,6-tetrachloro-p-benzoquinone, 2,3-dichloro-5,6-dicyano-p-benzoquinone, 3,4,5,6-tetrachloro-o-benzoquinone, naphthoquinones, 9,10-anthraquinone, 9,10-phenanthraquinone such as described by R. O. Loutfy, C. K. Hsiao, B. S. Ong and B. Keoshkerian in Canadian Journal of Chemistry, Vol. 62, page 1877 (1984);

(3) the aromatic polyketones of (2) condensed with at least one molecule of malonodinitrile, a malononitrile monocarboxyester or a malonic acid diester, e.g. tetracyanoquinodimethane (TCNQ), tetracyanonaphthoquinodimethane (TCNNQ) and tetracyanoanthraquinodimethane (TCNAQ) such as described in U.S. Pat. Nos. 4,606,861, 4,609,602, 4,514,481 and by R. O. Loutfy, C. K. Hsiao, B. S. Ung and B. Keoshkerian in Canadian Journal of Chemistry, Vol. 62, page 1877 (1984);

(4) cyanoalkylene compounds, e.g. tetracyanoethylene (TCNE);

(5) aromatic polycyclic compounds with electron withdrawing substituents e.g. 9-bromoanthracene, 9,10-dibromoanthracene, 9-chloroanthracene, 9,10-dichloroanthracene;

Examples of polymeric n-type substances useful in the present invention are from one of the classes:

(I) polymeric aromatic monoketones in which the aromatic nucleus is optionally substituted with at least one electron withdrawing substituent, e.g. halogen, nitro group, cyanide group, carboxylic acid ester group and/or acyl group, e.g. polymers incorporating 2,4,7-trinitrofluorenone as described e.g. by S. R. Turner in Macromolecules, Vol. 13, page 782 (1980);

(II) polymeric aromatic polyketones in which the aromatic nucleus is optionally substituted with at least one electron withdrawing substituent, e.g. halogen, nitro group, cyanide group, carboxylic acid ester group and/or acyl group;

(III) polymeric aromatic polyketones of (II) condensed with at least one molecule of malonodinitrile, a malononitrile monocarboxy ester or a malonic acid diester;

(IV) polymeric compounds containing cyanoalkylene groups;

(V) polymeric compounds containing aromatic groups with at least one electron withdrawing substituent, e.g. halogen, a nitro group, a cyanide group, a carboxylic acid ester group and/or an acyl group as described e.g. in U.S. Pat. Nos. 4,007,043; 4,013,623; FR-P 2 324 614 and DE-OS 2 627 983;

The resin binders are selected on the basis of optimal mechanical strength, adherence to any adjacent layer(s) and favourable electrical properties and if the active layer is at the same time the outermost layer also on the basis of reducing their surface energy and frictional coefficient in order to improve the resistance of the surface of the photosensitive recording material to toner smearing and abrasion and the ease with which untransferred toner can be removed.

Suitable binder material for use in the recording material of the present invention are organic resin materials, e.g. cellulose esters, acrylate and methacrylate resins, e.g. cyanoacrylate resin, polyvinyl chloride, copolymers of vinyl chloride, e.g. copolyvinyl chloride-/acetate and copolyvinylchloride/maleic anhydride, polyester resins, e.g. copolyesters of isophthalic acid and terephthalic acid with glycol, aromatic polycarbonate resins and polyester carbonate resins.

Particularly good results are obtained by using an aromatic polycarbonate resin as main (at least 51% by weight) constituent of the binder material.

The recording layer as outermost layer can be endowed with a low surface adhesion and a low frictional coefficient by the incorporation therein of a resin comprising a block copolyester or copolycarbonate having a fluorinated polyether block as described in U.S. Pat. No. 4,772,526.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of the following general formula:

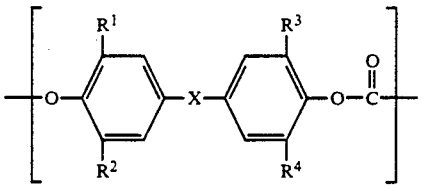

wherein:

X represents S, $SO_2$,

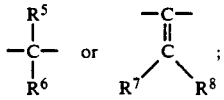

$R^1$, $R^2$, $R^3$, $R^4$, $R^7$ and $R^8$ each represents (same or different) hydrogen, halogen, an alkyl group or an aryl group, and $R^5$ and $R^6$ each represent (same or different) hydrogen, an alkyl group, an aryl group or together represent the necessary atoms to close a cycloaliphatic ring, e.g. cyclohexane ring.

Aromatic polycarbonates having a molecular weight in the range of 10,000 to 200,000 are preferred. Suitable polycarbonates having such a high molecular weight are sold under the registered trade mark MAKROLON of Bayer AG, W-Germany.

MAKROLON CD 2000 (registered trade mark) is a bisphenol A polycarbonate with molecular weight in the range of 12,000 to 25,000 wherein $R^1=R^2=R^3=R^4=H$, X is

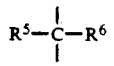

with $R^5=R^6=CH_3$.

MAKROLON 5700 (registered trade mark) is a bisphenol A polycarbonate with molecular weight in the range of 50,000 to 120,000 wherein $R^1=R^2=R^3=R^4=H$, X is

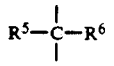

with $R^5=R^6=CH_3$.

Further useful binder resins are silicone resins, polystyrene and copolymers of styrene and maleic anhydride and copolymers of butadiene and styrene.

The photoconductive recording layer may contain further additives such as spectral sensitizing agents known in the art, e.g. (poly)methine dyes, for enlarging the spectral sensitivity of the applied photoconductive compounds, and compounds acting as stabilising agents against deterioration by ultra-violet radiation, so-called UV-stabilizers, e.g. benztriazoles.

For controlling the viscosity of the coating compositions and controlling their optical clarity silicone oils may be used.

An adhesive layer and/or blocking layer being optionally present between the conductive support and the photoconductive recording layer may contain or consist of one or more of e.g. a polyester, a polyamide, nitrocellulose, hydrolysed silane, or aluminium oxide. The total layer thickness of said layer(s) is preferably not more than 2 micron.

The photoconductive recording layer may be coated optionally with a thin protective layer to endow its surface with improved abrasion resistance, a reduced frictional coefficient, reduced tendency to toner smearing and more easy removal of untransferred toner. Such layers may contain one or more electron-transporting charge transport materials. The concentration of such charge transport materials present preferably does not exceed 50 wt % to avoid excessive abrasion in use. When charge transport materials are present in said protective layer the thickness of said layer will be preferably in the range of 5 to 50 μm.

In the absence of such charge transport materials the thickness of a protective layer should be less than 5 μm thick and preferably less than 2 μm thick to avoid a significant increase in residual potential.

Suitable resins for use in such protective layer are block copolyester or copolycarbonate resins having a fluorinated polyether block as described e.g. in U.S. Pat. No. 4,772,526, or are copolymers of tetrafluoroethene or hexafluoropropene, optionally in combination with resins compatible therewith, e.g. cellulose esters, acrylate and methacrylate resins, e.g. cyanoacrylate resin, polyvinyl chloride, copolymers of vinyl chloride, e.g. copolyvinyl chloride/acetate and copolyvinyl chloride/maleic anhydride, polyester resins, aromatic polycarbonate resins or polyester-carbonate resins.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall positively electrostatically charging, e.g. with corona-device, the recording material of the present invention, (2) image-wise photo-exposing the recording material according to the present invention thereby obtaining a latent electrostatic image.

The development of the latent electrostatic image commonly occurs preferably with finely divided electrostatically attractable material, called toner particles that are attracted by Coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, New York, enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the photoconductive recording layer may be used in combination with all kinds of photon-radiation, e.g. light of the visible spectrum, infra-red light, near ultra-violet light and likewise X-rays when electron-positive hole pairs can be formed by said radiation in the recording layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatique effect can be used in recording apparatus operating with rapidly following copying cycles including the sequential steps of overall charging, imagewise exposing, toner development and toner transfer to a receptor element.

The evaluations of electrophotographic properties determined on the recording materials of the following examples relate to the performance of the recording materials in an electrophotographic process with a reusable photoreceptor. The measurements of the performance characteristics were carried out as follows:

Two procedures were used for evaluating the discharge as a function of exposure: a routine sensitometric measurement in which the discharge was obtained for 8 different exposures including zero exposure and a more refined measurement in which the discharge was obtained for 360 different exposures in a single drum rotation.

In the routine sensitometric measurement the photoconductive recording sheet material was mounted with its conductive backing on an aluminium drum which was earthed and to which the conductive backing had been connected. The drum was rotated at a circumferential speed of 5 cm/s and the recording material sequentially charged with a positive corona at a voltage of +4,6 kV operating with a corona current of about 1 μA per cm of corona wire, exposed (simulating imagewise exposure) with monochromatic light obtained from a monochromator positioned at the circumference of the drum at an angle of 45° with respect to the corona source for 400 ms, the voltage measured with an electrometer probe positioned at an angle of 180° with respect to the corona source and finally post-exposed with a halogen lamp producing 54,000 mJ/m2 positioned at an angle of 270° with respect to the corona source before starting a new copying cycle.

Each measurement consisted of 40 copying cycles with the exposure being changed every 5 copying cycles by using a constant light intensity ($I_o$) initially using no light attenuating filter, and thereupon sequentially a filter with an optical density of 0.5, a filter with an optical density of 1.0, filters with a total optical density of 1.5, a filter with an optical density of 2.0, filters with a total optical density of 2.5, filters with a total optical density of 3.0 and finally a shutter to shut off the exposing light. This gives the discharges for 8 predetermined exposures.

In the refined sensitometric measurement the photoconductive recording sheet material is mounted on an aluminium drum as described above. The drum was rotated at a circumferential speed of 2 cm/s and the recording material sequentially charged with a positive corona at a voltage of +4.3 kV operating with a corona current of about 0.5 μA per cm of corona wire, exposed (simulating image-wise exposure) with monochromatic light obtained from a monochromator positioned at the circumference of the drum at an angle of 40° with respect to the corona source for 500 ms, the voltage measured with an electrometer probe positioned at an angle of 90° with respect to the corona source and finally post-exposed with a halogen lamp producing 2,000 mJ/m2 positioned at an angle of 300° with respect to the corona source before starting a new copying cycle. Each measurement consisted of a single copying cycle in which a density disc with continuously varying optical density from an optical density of 0 to an optical density of 2.1 over a sector of 210° was rotated in front of the monochromator synchronously with the rotation of the drum with the surface potential being measured every degree of rotation. This gives the discharges for 360 predetermined exposures and hence a complete sensitometric curve, whereas the routine measurement only gives 8 points on that curve.

The recording material fatigue was determined using the same configuration as for the routine sensitometric measurement, but in this case at a specific exposure. 100 Copying cycles were carried out in which 10 cycles without monochromatic light exposure were alternated with 5 cycles with monochromatic light exposure. The charging level (CL) was taken as the average charging level over the 90th to 100th cycle.

The % discharge is defined as:

$$\frac{(CL - RP)}{CL} \times 100$$

wherein RP is the average residual potential over the 85th to 90th cycle. The fatigue F can be calculated as the difference in residual potential in volts between said RP and the average residual potential over the 10th to 15th cycle.

For a given corona voltage, corona current, separating distance of the corona wires to recording surface and drum circumferential speed the charging level CL is only dependent upon the thickness of the charge transport layer and its specific resistivity. In practice CL expressed in volts should be preferably $\geqq 30$ d, where d is the total thickness in um of the combined photosensitive and protective layers.

In the drawing sensitometric curves are given with in the abscissa logarithmic values of exposure dose at 650 nm [log E=log I·t] expressed in mJ/m$^2$ and in the ordinate voltage values [V] measured on the charged recording layer during the exposure using increasing exposure doses at constant exposure times, wherein FIG. 1 is the sensitometric curve determined for the photoconductor of Example 10;

EXAMPLES 1 to 10

In the production of the photosensitive recording materials a 100 μm thick polyester film precoated with a vacuum-deposited conductive layer of aluminium was doctor-blade coated with a dispersion of charge generating pigment containing charge transport material, the respective compositions being given in Table 1, to thicknesses in μm also given in Table 1.

Said dispersion was prepared by first predispersing the X-metal-free phthalocyanine with 5% by weight of the aromatic polycarbonate MAKROLON CD 2000 (registered trade mark) [P1] in the final formulation in dichloromethane for 20 minutes in a pearl mill. The balance of the aromatic polycarbonate, the required quantity of the charge transport material specified in Table 1, the required quantity of a polyester adhesion-promoting additive DYNAPOL L206 (registered trade mark) [P2] and the balance of dichloromethane were then added and the resulting mixture mixed for a further 5 minutes in a pearl mill. The weight percentage of said ingredients are given in Table 1 with dichloromethane as coating solvent (40.4 g/g X-metal-free-phthalocyanine). The dispersion was cast without further dilution with dichloromethane and the resulting layer dried for 15 hours at 50° C.

Figure 1:
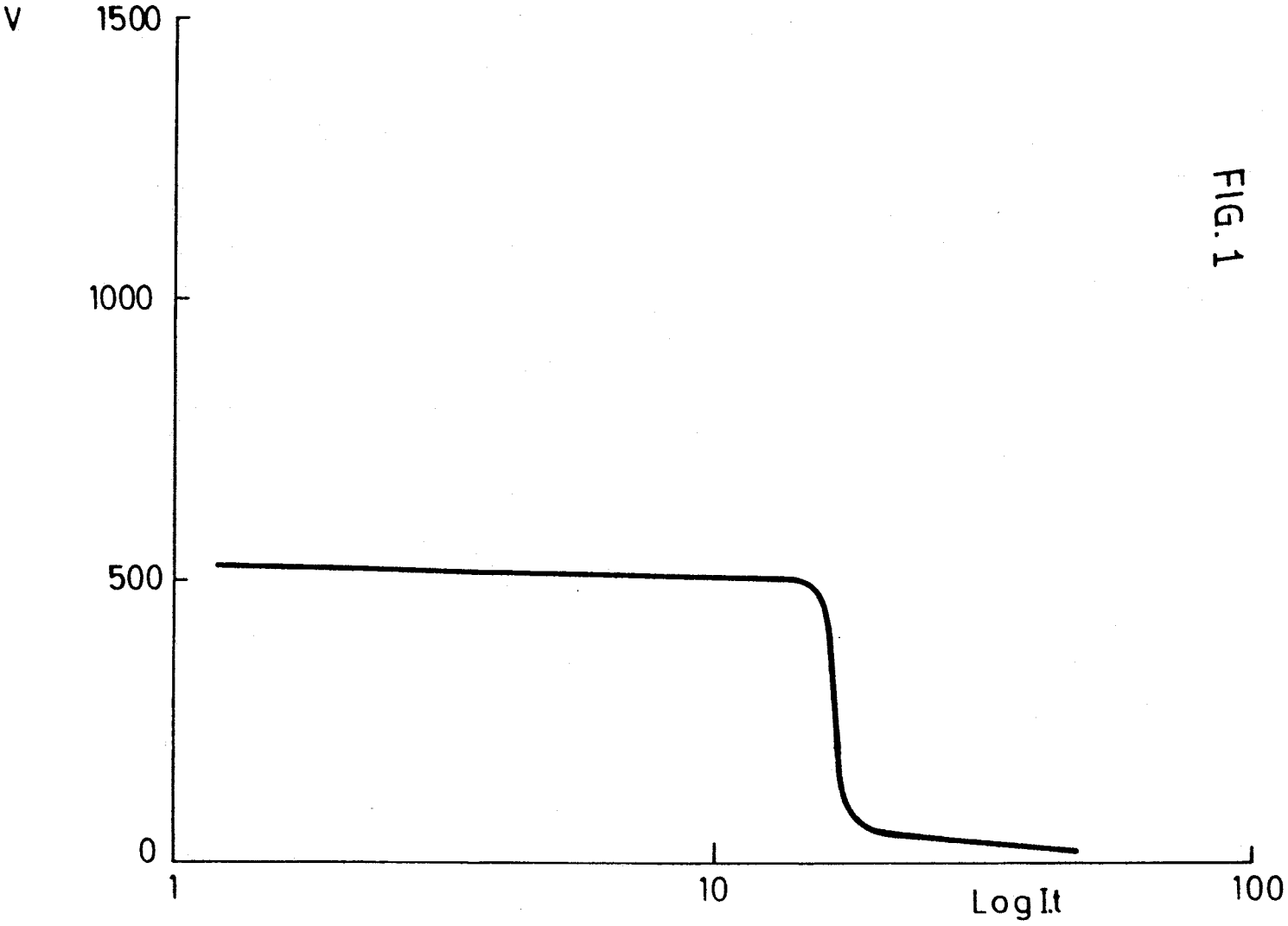

The characteristics of the thus obtained photosensitive recording materials were determined as described above. The sensitivity to monochromatic 650 nm light exposure is expressed as the Δ% discharge at an exposure ($I_{650}t$) of 26.4 mJ/m2 and the steepness of the discharge-exposure dependence is expressed as the % discharge observed between exposures ($I_{650}t$) of 8.35 mJ/m2 and 26.4 mJ/m2, a factor of 3.16 difference in exposure. The results are given in Table 1. The sensitometric curve determined for the photoconductor of Example 10 using the refined technique is shown in FIG. 1.

tor blade coated with a dispersion of 15 wt % of the Beta-form of copper phthalocyanine (C.I. Pigment Blue 15:3) in a solution of 0.1 wt % of o-chloranil, 76.4 wt % of the aromatic polycarbonate MAKROLON CD 2000 (registered trade mark) and 8.5 wt % of a polyester adhesion-promoting additive DYNAPOL L 206 (registered trade mark) in dichloromethane (40.49 g copper phthalocyanine). Said dispersion was prepared by mixing the ingredients together with the dichloromethane for 15 minutes in a pearl mill. This dispersion was cast without further dilution with dichloromethane and the resulting 12 μm thick layer was dried for 15 h at 50° C.

The characteristics of the thus obtained photosensitive recording material were determined as described above and are summarized below:

CL = +743 V

TABLE 1

| Example no. | X-phthalocyanine conc. [wt %] | CTM | CTM-conc. [wt %] | P1 conc. [wt %] | P2 conc. [wt %] | layer thickness [μm] | CL [V] | % discharge for $I_{650}t$ = 83.5 mJ/m2 | Δ% discharge between $I_{650}t$'s of 26.4 and 83.5 mJ/m2 |
|---|---|---|---|---|---|---|---|---|---|
| 1 | 15 | o-chloranil | 0.1 | 76.4 | 8.5 | 16 | +836 | 95.5 | 103.9* |
| 2 | 15 | o-chloranil | 0.03 | 76.5 | 8.5 | 11 | +917 | 94.5 | 95.5 |
| 3 | 15 | o-chloranil | 0.01 | 76.5 | 8.5 | 11 | +954 | 94.0 | 96.8 |
| 4 | 15 | tetracyanoethene | 0.01 | 76.5 | 8.5 | 12 | +674 | 89.8 | 94.7 |
| 5 | 15 | 2,3-dichloro-5,6-dicyano-p-benzoquinone | 0.01 | 76.5 | 8.5 | 12 | +521 | 87.9 | 107.8* |
| 6 | 15 | 9,10-phenanthraquinone | 10 | 67.5 | 7.5 | 13 | +931 | 93.6 | 113.4* |
| 7 | 25 | 9,10-phenanthraquinone | 5 | 63.0 | 7.0 | 11 | +910 | 97.0 | 138.6* |
| 8 | 25 | 9,10-phenanthraquinone | 1 | 66.6 | 7.4 | 11 | +918 | 97.8 | 99.6 |
| 9 | 25 | 9-bromo-anthracene | 5 | 63.0 | 7.0 | 10 | +810 | 96.8 | 98.6 |
| 10 | 25 | 9-bromo-anthracene | 1 | 66.6 | 7.4 | 10 | +839 | 96.1 | 95.5 |

*CL-fatigue

EXAMPLES 11 to 17

The photosensitive recording materials of Examples 11 to 17 were prepared as described for Examples 1 to 10 and their compositions are given in Table 2.

Figure 2:
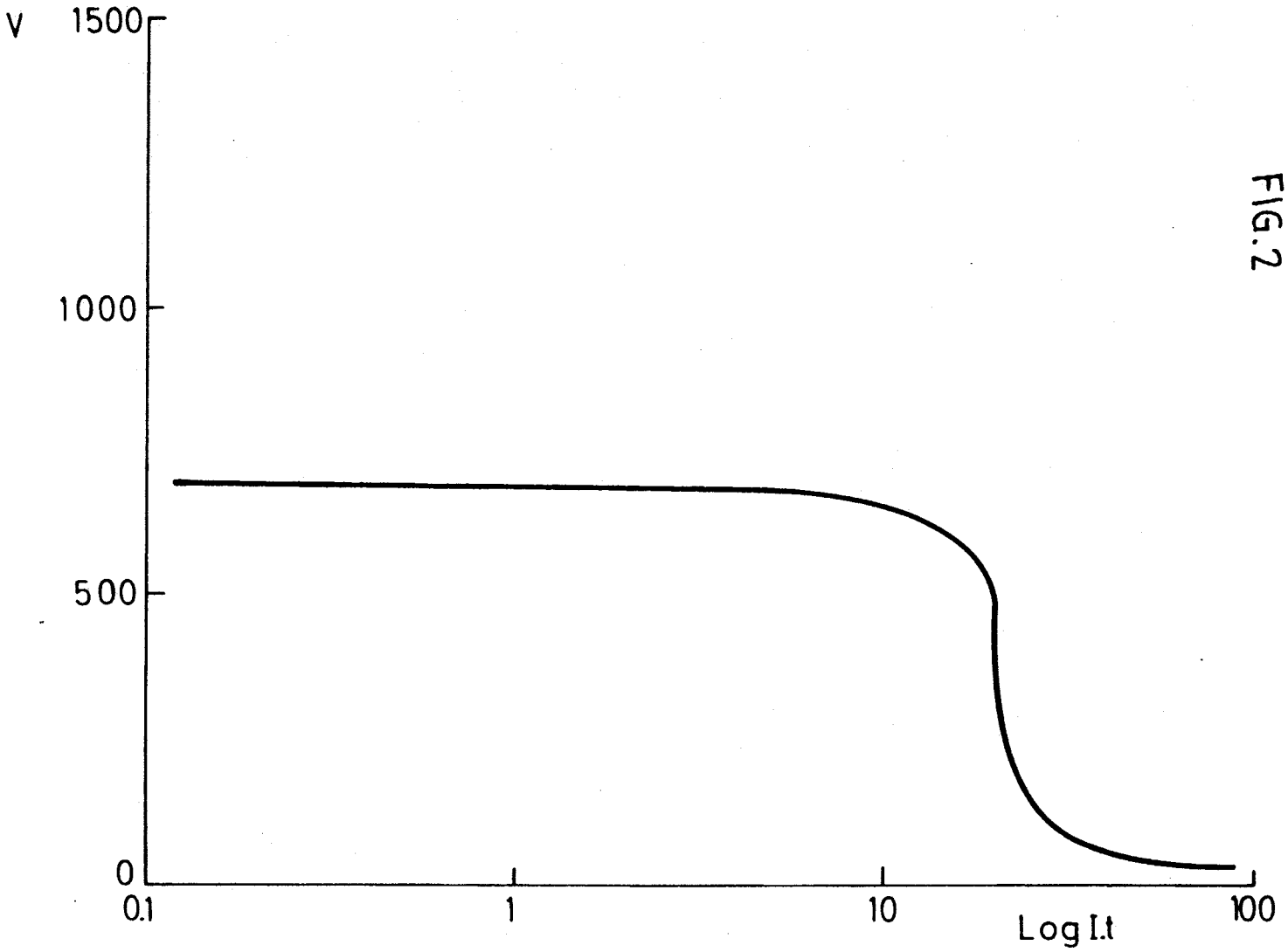
FIG. 2 is the sensitometric curve for the photoconductor of Example 12.
Figure 3:
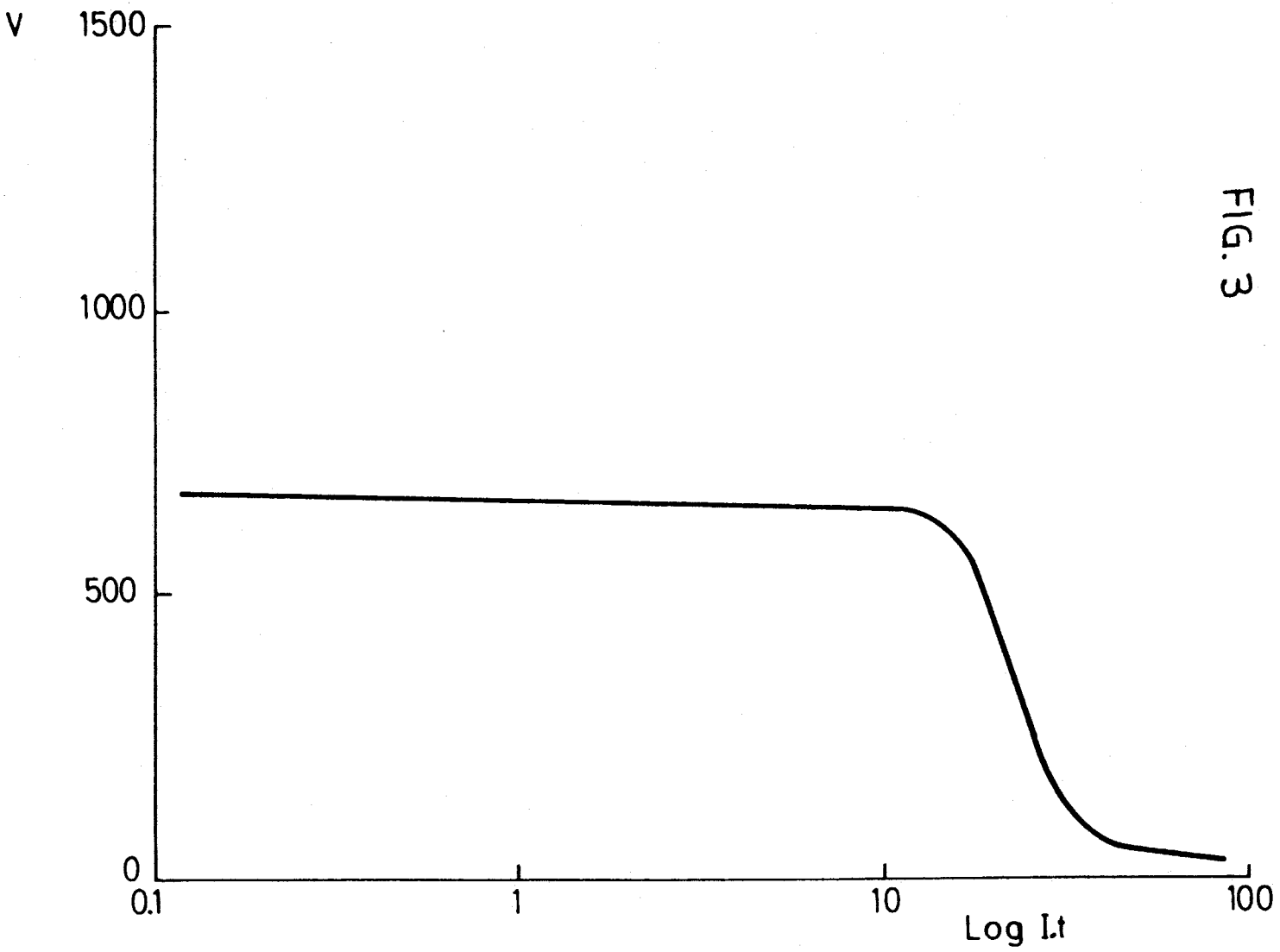
FIG. 3 is the sensitometric curve for the photoconductor of Example 13.
Figure 4:
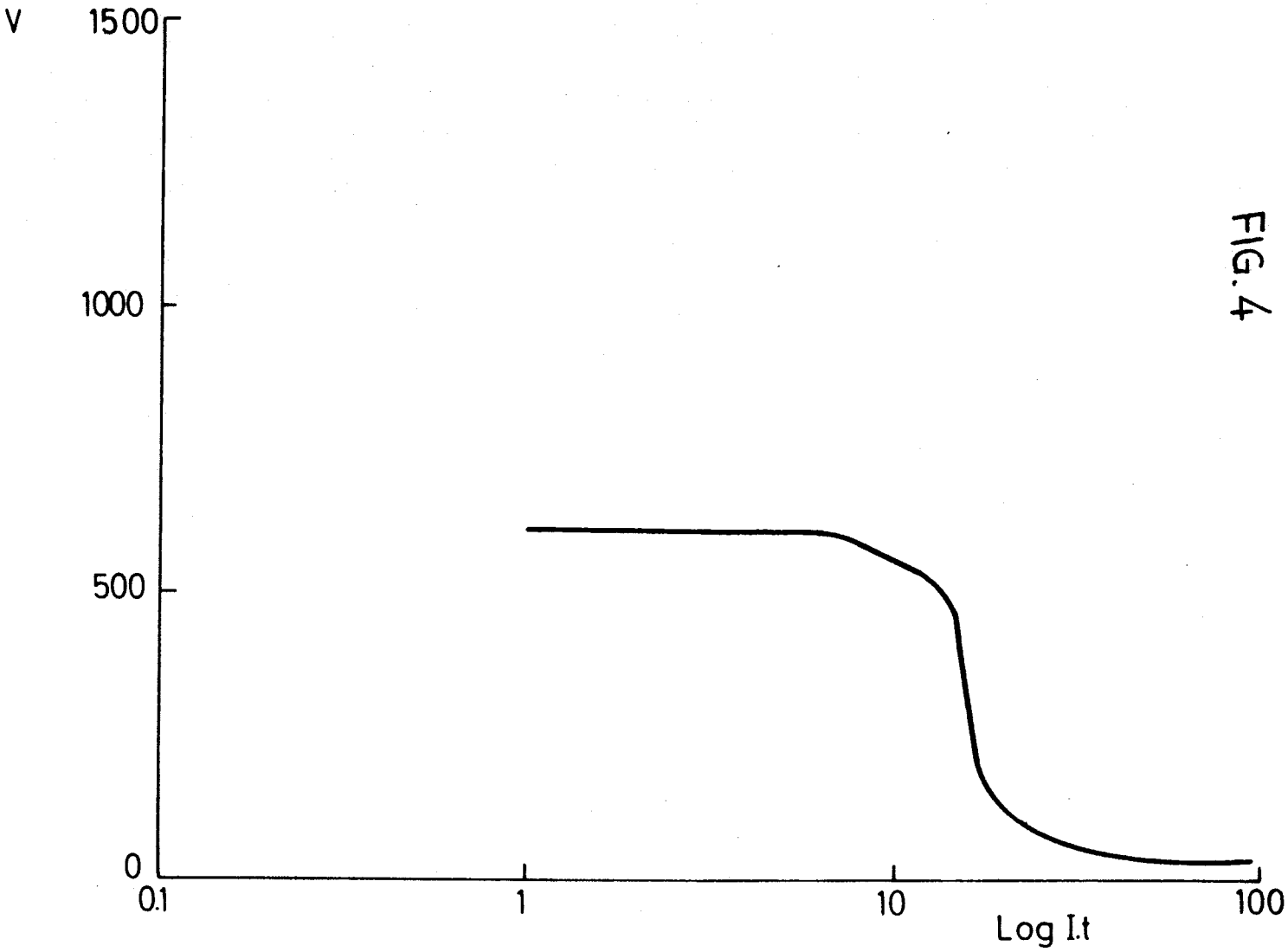
FIG. 4 is the sensitometric curve for the photoconductor of Example 17.

The characteristics of the thus obtained photosensitive recording materials were determined as described above. The sensitivity to monochromatic 650 nm light exposure is expressed as the % discharge at an exposure ($I_{650}t$) of 83.5 mJ/m$^2$ and the steepness of the discharge-exposure dependence is expressed as the Δ % discharge observed between exposures ($I_{650}t$) of 26.4 mJ/m$^2$ and 83.5 mJ/m$^2$, a factor of 3.16 difference in exposure. The results are given in Table 2. The sensitometric curves for the photoconductors of Examples 12, 13 and 17 determined using the refined technique are shown in FIGS. 2, 3 and 4 respectively.

% discharge at $I_{650}t$ of 26.4 mJ/m$^2$ = 83.0.

Δ % discharge between $I_{650}t$'s of 8.35 and 26.4 mJ/m$^2$ = 78.1.

COMPARATIVE EXAMPLES 1 to 3

The photosensitive recording materials of Comparative Examples 1 to 3 were prepared as described for Examples 1 to 10.

The compositions of the recording layers containing n-conducting pigments and n-conducting charge transport materials are given in Table 3.

The characteristics of the thus obtained photosensitive recording materials were determined as described above except that they were exposed to monochromatic 540 nm light instead of monochromatic 650 nm light. None of these layers exhibited any sensitivity when positively charged and exposed to monochromatic 540 nm light.

TABLE 2

| Example no. | X-phthalocyanine conc. [wt %] | CTM | CTM-conc. [wt %] | P1 conc. [wt %] | P2 conc. [wt %] | layer thickness [μm] | CL [V] | % discharge for $I_{650}t$ = 26.4 mJ/m2 | Δ% discharge between $I_{650}t$'s of 8.35 and 26.4 mJ/m2 |
|---|---|---|---|---|---|---|---|---|---|
| 11 | 15 | 9,10-phenanthraquinone | 5 | 72.0 | 8.0 | 13 | +986 | 96.9 | 105.1* |
| 12 | 15 | o-chloranil | 0.003 | 76.5 | 8.5 | 13 | +943 | 97.5 | 63.5 |
| 13 | 15 | o-chloranil | 0.001 | 76.5 | 8.5 | 13 | +916 | 97.3 | 92.1 |
| 14 | 15 | p-benzoquinone | 0.1 | 76.5 | 8.4 | 12 | +878 | 92.7 | 91.2 |
| 15 | 15 | 8-nitro-1,4-naphthoquinone | 0.1 | 76.5 | 8.4 | 13 | +989 | 96.3 | 93.3 |
| 16 | 15 | 2-chloro-1,4-naphthoquinone | 0.1 | 76.5 | 8.4 | 12 | +987 | 97.4 | 94.5 |
| 17 | 15 | 2,3-dichloro-1,4-naphthoquinone | 0.1 | 76.5 | 8.4 | 13 | +965 | 96.9 | 92.5 |

*CL-fatigue

EXAMPLE 18

A 100 μm thick polyester film precoated with a vacuum-deposited conductive layer of aluminium was doc-

TABLE 3

| Compar. Example No. | n-conducting pigment | pigment conc. [wt %] | CTM [wt %] | CTM conc. [wt %] | P1 conc. [wt %] | P2 conc. [wt %] | layer thickness [μm] |
|---|---|---|---|---|---|---|---|
| 1 | 4,10-dibromo-anthanthrone | 15 | o-chloranil | 0.1 | 76.4 | 8.5 | 13 |
| 2 | tribromo-pyranthrone | 15 | o-chloranil | 0.1 | 76.4 | 8.5 | 14 |
| 3 | trans perinone | 15 | o-chloranil | 0.1 | 76.4 | 8.5 | 14 |

EXAMPLE 19

The photosensitive recording material of Example 19 was produced by first doctor blade coating a 100 μm thick polyester film precoated with a vacuum-deposited conductive layer of aluminum with a 3% solution of γ-aminopropyl-triethoxy silane in aqueous methanol. After evaporating the solvent and curing the resulting adhesion/blocking layer at 100° C. for 30 minutes, the adhesion/blocking layer was overcoated with a dispersion of charge generating pigment containing charge transport material.

Said dispersion was prepared by mixing 1 g of the χ-form of metal-free phthalocyanine, 0.0002 g of o-chloranil, 0.85 g of aromatic polycarbonate MAKROLON CD 2000 (registered trade mark) and 23.70 g of dichloromethane for 15 minutes in a pearl mill. 4.81 g of MAKROLON CD 2000 (registered trade mark) and 13.11 g of dichloromethane were then added and the resulting mixture was mixed for a further 5 minutes to produce the composition and viscosity for casting. The photosensitive layer was then dried for 16 hours at 50° C. and had in dry state a thickness of 11 μm.

The characteristics of the thus obtained photosensitive recording material were determined as described above. The sensitivity to monochromatic 650 nm light exposure is expressed as the % discharge at an exposure ($I_{650}t$) of 83.5 mJ/m$^2$ and the steepness of the discharge-exposure dependence is expressed as the Δ % discharge observed between exposures ($I_{650}t$) of 26.4 mJ/m$^2$ and 83.5 mJ/m$^2$, a factor of 3.16 difference in exposure.

The results are summarized below:

CL = +739 V

% discharge at $I_{650}t$ of 83.5 mJ/m$^2$ = 97.7.

Δ % discharge between $I_{650}t$'s of 26.4 and 83.5 mJ/m$^2$ = 89.3.

EXAMPLE 20

The photosensitive recording material of Example 20 was prepared as described for Examples 1 to 10 with the difference however, that the recording layer consisted of 10 wt % of χ-metal-free phthalocyanine, 2.5 wt % of phenanthraquinone, 78.75 wt % of the aromatic polycarbonate MAKROLON CD 2000 (registered trade mark) and 8.75 wt % of a polyester adhesion-promoting additive DYNAPOL L206 (registered trade mark).

The characteristics of the thus obtained photosensitive recording material were determined as described above and are summarized below:

CL = +706 V

% discharge at $I_{780}t$ of 20.7 mJ/m$^2$ = 94.5.

Δ % discharge between $I_{780}t$'s of 6.56 and 20.7 mJ/m$^2$ = 92.5.

EXAMPLE 21

The photosensitive recording material of Example 21 was prepared as described in Examples 1 to 10 with the difference however, that the recording layer consisted of 15 wt % of the β-form of copper phthalocyanine (C.I. Pigment Blue 15:3), 1 wt % of 2,2-dimethylindan-1,3-dione, 75.6 wt % of the aromatic polycarbonate MAKROLON CD 2000 (registered trade mark) and 8.4 wt % of a polyester adhesion promoting additive DYNAPOL L206 (registered trade mark).

The characteristics of the thus obtained photosensitive recording material were determined as described above and are summarized below:

CL = +852 V

% discharge at $I_{650}t$ of 83.5 mJ/m$^2$ = 74.2.

Δ % discharge between $I_{650}t$'s of 26.4 and 83.5 mJ/m$^2$ = 66.2.

EXAMPLE 22

The photosensitive recording material of Example 22 was prepared as described for Examples 1 to 10 with the difference however, that the recording layer consisted of 15 wt % of the β-form of copper phthalocyanine (C.I. Pigment Blue 15:3), 1 wt % of 1-dicyanomethylene-2,2-dimethylindan-1,3-dione, 75.6 wt % of the aromatic polycarbonate MAKROLON CD 2000 (registered trade mark) and 8.4 wt % of a polyester adhesion promoting additive DYNAPOL L206 (registered trade mark).

The characteristics of the thus obtained photosensitive recording material were determined as described above and are summarized below:

CL = +941 V

% discharge at $I_{650}t$ of 83.5 mJ/m$^2$ = 78.5.

Δ% discharge between $I_{650}t$'s of 26.4 and 83.5 mJ/m$^2$ = 68.9.

EXAMPLE 23

The photosensitive recording material of Example 23 was prepared as described for Examples 1 to 10 with the difference however, that the recording layer consisted of 8 wt % of the χ-form of metal-free phthalocyanine, 2.5 wt % of phenanthraquinone, 80.5 wt % of the aromatic polycarbonate MAKROLON CD 2000 (registered trade mark) and 9.0 wt % of a polyester adhesion promoting additive DYNAPOL L206 (registered trade mark). The layer thickness was 15 μm.

The characteristics of the thus obtained photosensitive recording material were determined as described above and are summarized below:

CL = +1036 V

% discharge at $I_{780}t$ of 20.7 mJ/m$^2$ = 82.4.

Δ% discharge between $I_{780}t$'s of 6.56 and 20.7 mJ/m$^2$ = 80.6.

EXAMPLE 24

The photosensitive recording material of Example 24 was prepared as described for Examples 1 to 10 with the difference however, that the recording layer consisted of 5 wt % of the χ-form of metal-free phthalocyanine, 2.5 wt % of phenanthraquinone, 83.25 wt % of the aromatic polycarbonate MAKROLON CD 2000 (registered trade mark) and 9.25 wt % of a polyester adhesion promoting additive DYNAPOL L206 (registered trade mark). The layer thickness was 16 μm.

The characteristics of the thus obtained photosensitive recording material were determined as described above and are summarized below:

CL = +1054 V

% discharge at $I_{780}t$ of 65.6 mJ/m² = 87.3.

Δ% discharge between $I_{780}t$'s of 20.7 and 65.6 mJ/m² = 81.3.

We claim:

1. An electrophotographic recording material comprising on an electrically conductive support a positively chargeable photoconductive recording layer which contains in an electrically insulating organic polymeric binder material at least one photoconductive p-type pigment substance selected from the group consisting of:

a) naphthalo- and phthalo-cyanines, b) quinoxaline pigments, and c) dioxazine pigments, and at least one n-type photoconductive charge transport substance selected from one of the following classes:

(i) aromatic monoketones;

(ii) aromatic polyketones;

(iii) aromatic polyketones of (ii) condensed with at least one molecule of malononitrile, a malononitrile monocarboxy ester or a malonic acid diester;

(iv) cyano alkylene compounds;

(v) aromatic compounds with at least one electron withdrawing substituent, wherein said layer has a thickness in the range of 4 to 40 μm and comprises 5 to 40% by weight of said p-type pigment substance and 0.0001 to 15% by weight of said n-type charge transport substance that is molecularly distributed in said electrically insulating organic polymeric binder material that has a volume resistivity of at least $10^{14}$ Ohm-m, and wherein said recording layer in electrostatically charged state requires for 10% and 90% discharge respectively exposures to conductivity increasing electromagnetic radiation that differ by a factor 5 or less.

2. An electrophotographic recording material according to claim 1, wherein the support of said photoconductive recording layer is pre-coated with an adhesive and/or a blocking layer.

3. An electrophotographic recording material according to claim 1, wherein the photoconductive recording layer is overcoated with an outermost protective layer.

4. An electrophotographic recording material according to claim 3, wherein said outermost protective layer contains one or more electron-transporting charge transport materials.

5. An electrophotographic recording material according to claim 1, wherein said recording layer has a thickness in the range of 5 to 35 μm and contains 6 to 30% by weight of said p-type pigment substance and 0.001 to 12% by weight of said n-type charge transport substance.

6. An electrophotographic recording material according to claim 1, wherein the p-type pigment is the χ-form of metal-free phthalocyanine.

7. An electrophotographic recording material according to claim 1, wherein the polymeric binder is an organic resin material selected from the group consisting of a cellulose ester, acrylate and methacrylate resin, polyvinyl chloride, copolymers of vinyl chloride, copolyvinyl chloride/acetate and copolyvinylchloride/maleic anhydride, polyester resin, aromatic polycarbonate resin and polyester carbonate resin.

8. An electrophotographic recording material according to claim 7, wherein an aromatic polycarbonate resin is present as main (at least 51% by weight) constituent of the binder material.

9. An electrophotographic recording material according to claim 1, wherein the polymeric binder is an aromatic polycarbonate having in its structure repeating units within the scope of the following general formula:

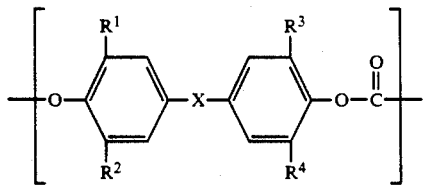

wherein:

X represents S, $SO_2$,

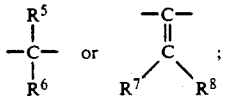

$R^1$, $R^2$, $R^3$, $R^4$, $R^7$ and $R^8$ each represents (same or different) hydrogen, halogen, an alkyl group or an aryl group, and $R^5$ and $R^6$ each represent (same or different) hydrogen, an alkyl group, an aryl group or together represent the necessary atoms to close a cycloaliphatic ring.

10. An electrophotographic recording material according to claim 1, wherein the polymeric binder consists of a combination of an aromatic polycarbonate and a copolyester of terephthalic acid and isophthalic acid with ethylene glycol and neopentyl glycol, the molar ratio of tere- to isophthalic acid being 3/2.

11. An electrophotographic recording material according to claim 1, wherein the n-type change transport substance is selected from the group consisting of orthochloranil, 3,4,5,6-tetrachloro-o-benzoquinone, phenanthraquinone and tetracyanoethylene.

* * * * *